US006354121B1

(12) United States Patent
Frolov

(10) Patent No.: US 6,354,121 B1
(45) Date of Patent: Mar. 12, 2002

(54) MORTISE LOCKSET WITH INTERNAL CLUTCH

(75) Inventor: George Frolov, Farmington, CT (US)

(73) Assignee: Harrow Products, Inc., Woodcliff Lake, NJ (US)

( * ) Notice: Subject to any disclaimer, the term of this patent is extended or adjusted under 35 U.S.C. 154(b) by 0 days.

(21) Appl. No.: 09/621,197

(22) Filed: Jul. 21, 2000

(51) Int. Cl.[7] ..... E05B 47/00

(52) U.S. Cl. ..... 70/277; 70/280; 70/134; 70/110.29; 70/472; 292/164; 292/144

(58) Field of Search ..... 70/277, 279.1, 70/280, 281, 282, 283, 107, 110.29, 134, 472; 292/164, 144

(56) References Cited

U.S. PATENT DOCUMENTS 5,044,184 A * 9/1991 Herbers et al. ..... 70/277
5,377,513 A * 1/1995 Miyamoto et al. ..... 70/276
6,145,353 A * 11/2000 Doucet ..... 70/277

* cited by examiner

*Primary Examiner*—William A. Cuchlinski, Jr.
*Assistant Examiner*—Olga Hernandez
(74) *Attorney, Agent, or Firm*—Alix, Yale & Ristas, LLP

(57) ABSTRACT

A mortise lockset incorporates an electrically actuated clutch within the lock case. The clutch selectively engages one latch operator to permit access through a door equipped with the lockset. The lockset further includes a key rotatable cam for retracting the latch. The lockset includes a lock bar that permits retraction of the latch by means external to the lockset. An extended throw deadbolt-like latch is held in a retracted position by an auxiliary latch and hook until released by retraction of the auxiliary latch. The latch incorporates a recessed roller in the projected end of the latch to facilitate latch deployment.

17 Claims, 11 Drawing Sheets

MORTISE LOCKSET WITH INTERNAL CLUTCH

BACKGROUND OF THE INVENTION

1. Field of the Invention

This invention relates generally to locksets employed to secure doors and electro-mechanical assemblies that permit locksets to be electrically locked and unlocked. More particularly, the present invention relates generally to a mortise-type lockset that incorporates an internal selectively engageable electro-mechanical clutch assembly.

2. Description of the Related Art

Locksets that incorporate a lockable latch and/or dead bolt have long been incorporated into doors. Electronic security systems for controlling access through doors are also common. Electronic security systems typically control access through doors incorporating mechanical locksets by selectively engaging the rotatable operator (usually a lever or knob) on the unsecured or outside side of the door. This has been accomplished by means of an electromechanical clutch mounted between the operator and the lockset. A properly activated clutch mechanically couples the operator to the lockset and permits rotation of the operator to retract the latch and allow entry through the door.

An example of this type of clutch may be found in U.S. Pat. No. 5,640,863. Such separate, add on clutches work well and have the advantage of being compatible with existing locksets, allowing existing key-based security systems to be retrofitted with electronic security capabilities. For new installations where electronic security systems will be installed or are contemplated, however, the separate installation and mechanical coupling of discrete clutches and locksets have proven to be awkward and time consuming. Separate clutch and lockset assemblies require a volume of installation space not always available in a given application. Additionally, designers may be constrained by the need to provide space for the necessary components.

Locksets used to control access through frequently used doors typically incorporate a beveled latch and a spring for biasing the latch in the projected or latched position. Such self-latching locksets have the advantage of automatically latching the door when it is closed, and with certain lock mechanisms, automatically locking the door. The beveled, spring biased latches employed in self-latching locksets have the disadvantage of being susceptible to tampering that may result in unauthorized entry. In many installations, tools or other slim objects can be slipped between the door and the doorframe to engage the beveled edge of the latch and force the latch into a retracted position, thereby allowing the door to be opened.

Dead bolts have been employed to overcome some of these deficiencies. Dead bolts typically have a squared off end which is not susceptible to tampering. Dead bolts also typically have a longer throw and are not spring biased, therefore maintaining the dead bolt in an extended position until the lock mechanism is employed to retract it. A major deficiency of dead bolts is that they must typically be manually engaged. Manual engagement is inconvenient for a door that is frequently used.

There is a need in the art for a lockset which provides the strength and tamper resistance of a dead bolt with the convenience and dexterity of an electrically lockable self-latching lockset.

SUMMARY OF THE INVENTION

Briefly stated, a preferred embodiment of the mortise lockset with internal clutch includes a self-latching autobolt and an electrically actuated coupling that permits retraction of the autobolt by the operator on the unsecured side of the door. A key actuation mechanism allows the lockset to be operated as a conventional key-based security system or operated in conjunction with an electronic security system.

The autobolt or self-latching dead bolt is spring biased toward a projected or latched position. A retraction lever is engaged with the autobolt and is pivotable by a key operated retraction cam or rotational movement produced by operators (levers or knobs) located on the secured and unsecured side of the door. Pivoting of the retraction lever overcomes the spring bias, resulting in retraction of the autobolt. Operators on the secured and unsecured sides of the door are connected to inside and outside cams in the lockset, respectively, for rotation therewith. The inside cam, located adjacent the secured side (inside) of the door, is continuously coupled to the retraction lever, allowing rotation of the operator to pivot the retraction lever and retract the autobolt. The outside cam, located adjacent the unsecured side (outside) of the door, is selectively coupled with the retraction lever. The inside and outside cams are positioned on either side of the retraction lever at the retraction lever pivot point. The inside cam, outside cam and retraction lever share a common axis of rotation.

Entry from the unsecured side of the door may be obtained either by actuating the electro-mechanical coupling between the outside cam and the retraction lever, or using a key to rotate the retraction cam. The electrically actuated coupling (clutch assembly) incorporates a motor which, by moving an injector and an injector arm, exerts force on a locking piece, resulting in rotational engagement of the outside cam to the retraction lever.

The locking piece is movably secured for rotation with the retraction lever by a pin and is spring biased toward a locked position in which the locking piece is disengaged from the outside cam. A convex head on the pin is slidably engaged along an arcuate surface of the pivotable injector arm. The injector arm is disposed between the pinhead and an axially movable injector. A rounded corner of the injector slidably engages a ramp on the injector arm, whereby the injector arm can be moved toward the clutch assembly by the injector. A coil spring drive shaft connects the injector to the motor such that rotation of the drive shaft moves the injector along an axis.

Rotation of the drive shaft in a first direction moves the rounded corner of the injector along the ramp of the injector arm, pivoting the injector arm to overcome the spring bias on the locking piece and force the locking piece into an unlocked position. In an unlocked position, the locking piece is engaged with the outside cam. Rotation of the drive shaft in a second direction moves the rounded corner of the injector in the opposite direction along the ramp of the injector arm, allowing the injector arm to be moved away from the clutch assembly by the spring bias on the locking piece. A locked position is achieved when the locking piece is disengaged from the outside cam. When the locking piece is in the locked position, the outside cam rotates independently of the retraction lever and rotation of the operator located on the unsecured side of the door will not retract the latch.

An autobolt assembly in accordance with the present invention includes a roller captured within a squared-off projectable end of the bolt. The roller is positioned so that a portion of the roller protrudes from the outer end face of the bolt. A projectable bi-beveled auxiliary latch and associated pivotable hook restrain the bolt in a retracted position in which only the roller protrudes from the latch edge of the door. The auxiliary latch is spring biased toward a projected position in which the auxiliary latch acts to pivot the hook into engagement with a notch in the bolt, restraining the bolt in the retracted position. A closing door causes the auxiliary latch to be forced into a retracted position in which the auxiliary latch acts to pivot the hook away from engagement with the bolt, releasing the bolt from its retracted position.

Upon release, the spring biased bolt moves toward a projected position causing the roller in the end face of the bolt to contact the strike plate. The roller rotates freely, allowing the bolt to move over the strike plate until the bolt is aligned with the latch opening in the strike plate, at which time the bolt projects fully into a latched position in the latch opening. Retracting the bolt and opening the door allows the auxiliary latch to re-assume its projected position, causing the hook to restrain the bolt in a retracted position until the door closes, thereby bringing the auxiliary latch into contact with the strike plate once again.

In a further embodiment in accordance with the invention, the bolt is locked in the projected position, ensuring that only the retraction lever can retract the bolt. A pivoting lock bar is spring biased toward a position in which the lock bar engages the rear or inner end of the projected bolt to prevent the bolt from being moved to the retracted position. The lock bar has a cam surface, which cooperates with a protrusion on the retraction lever. Movement of the retraction lever to retract the bolt also moves the lock bar to a position where the lock bar does not interfere with retraction of the bolt. The lock bar prevents potential unauthorized entry by maintaining the latch bolt in the projected position despite the presence of a countering force applied by a tool or other object. The lock bar is inaccessible to a burglar and can be disengaged only by movement of the retraction lever.

A further alternative embodiment combines the electrically actuated clutch assembly with a more conventional self-latching mortise lockset.

An object of the present invention is to provide a new and improved lockset that incorporates an internal electrically actuated clutch mechanism.

Another object of the present invention is to provide a new and improved lockset that is self-latching but includes the security advantages of a dead bolt.

A further object of the present invention is to provide a new and improved lockset that may be incorporated into either a standard key-based access control system or an electronic access control system.

These and other objects, features, and advantages of the invention will become readily apparent to those skilled in the art upon reading the description of the preferred embodiments, in conjunction with the accompanying drawings.

DETAILED DESCRIPTION OF THE PREFERRED EMBODIMENTS

Figure 1:
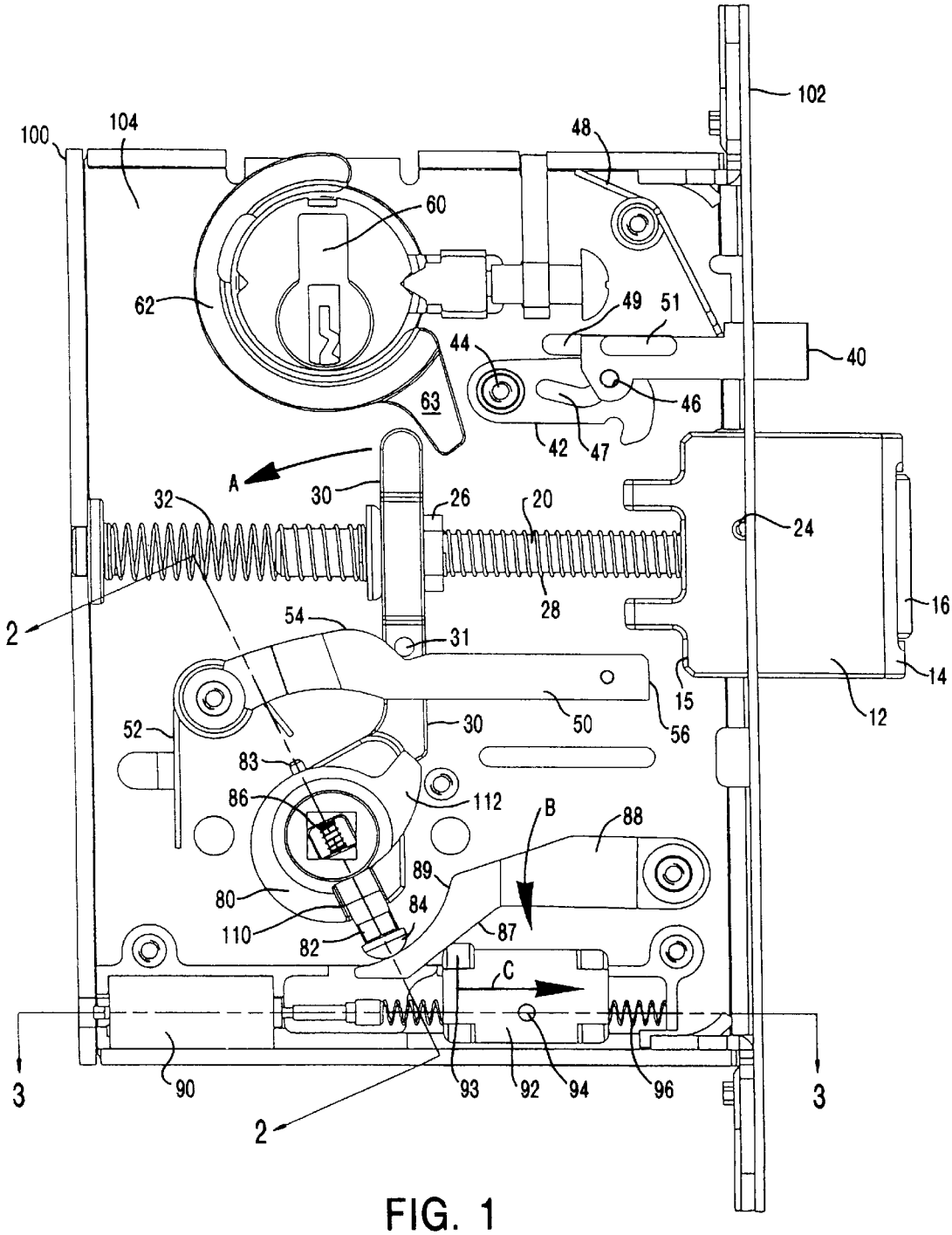
FIG. 1 is a side view illustrating the locked configuration of the clutch components in a mortise lockset in accordance with the present invention.

With reference to the drawings wherein like numerals represent like parts throughout the several figures, a first embodiment of the mortise lockset, in accordance with the present invention is generally designated by the numeral 10. The mortise lockset 10 is mountable in the mortise of a door and is adapted to engage the strike of a doorframe (see FIG. 13). Latch operators on the secured (inside) of a door and the unsecured (outside) of a door connect to the lockset 10 via cams 23, 24 for operation of the lockset. The mortise lockset 10 is equipped with both key and electromechanical locking assemblies, allowing the mortise lockset 10 to be operated as a conventional keyed lockset or be incorporated into an electronic access control system.

The mortise lockset comprises a substantially rectangular lock case 100 that includes an integral backing plate 104. The case 100 provides a mounting surface for the components as well as protective housing and a support for mounting the mortise lockset 10 in the mortise of a door. When the mortise lockset 10 is installed in the mortise of a door, the face plate 102 is flush with the latch edge of the door and disposed in opposing parallel relationship to the strike of the door frame when the door is closed (see FIG. 13).

The Figures illustrate the mortise lockset 10 with the front plate 106 of the lock case 100 removed, so the internal components are easily viewed. With the exception of the bolt 12 and auxiliary bolt 40, all the components of the mortise lockset, including the clutch mechanism, the key override, the lock bar and the electrical clutch actuation components are contained within the case 100. The case 100 provides pivot points for some components, such as the lock bar 50, the bolt hook 42 and the injector arm 88.

Figure 2:
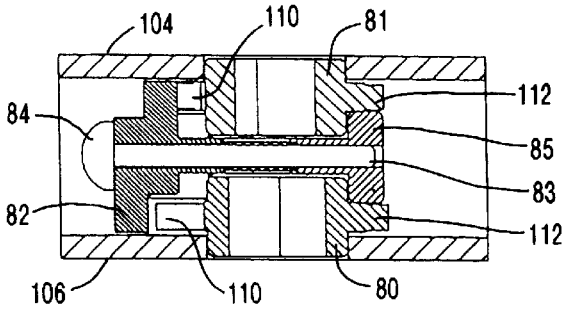
FIG. 2 is a partial sectional view of the mortise lockset of FIG. 1, taken along line 2—2 thereof.
Figure 5:
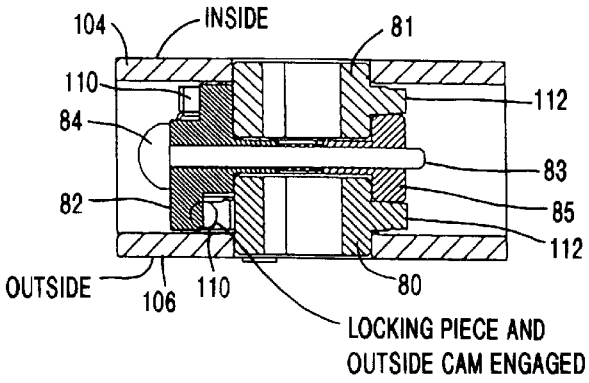
FIG. 5 is a partial sectional view of the mortise lockset of FIG. 4, taken along line 5—5 thereof.

Other components are mounted for rotation within the case, such as the key override cam 62 and the retraction lever 30/inside cam 81/outside cam 80 (clutch) assembly. FIGS. 2 and 5 illustrate a sectional view through the clutch assembly and show the components mounted for rotation between the backing plate 104 and the front plate 106. Other components, such as the auxiliary bolt 40, are provided with tabs 51 that are configured to slide within slots 49 in the backing plate 104 and the front plate 106. Still further components, such as the throw rod stop 26 are fixedly mounted between the backing plate 104 and the front plate 106 (best seen in FIG. 11). When assembled, the mortise lockset may be installed in a rectangular mortise typical of any conventional mortise lockset.

Figure 4:
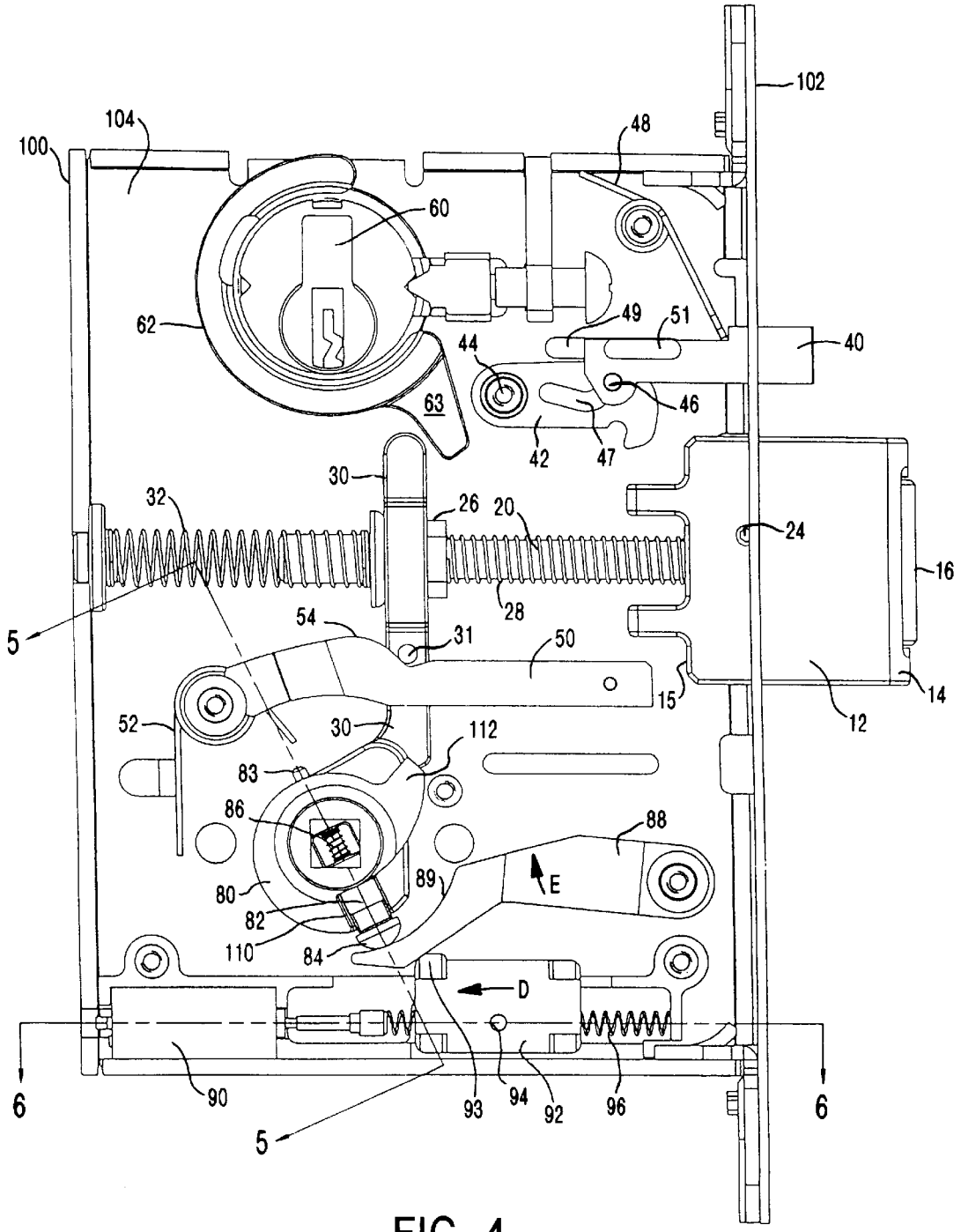
FIG. 4 is a side view illustrating the unlocked configuration of the clutch components in a mortise lockset in accordance with the present invention.
Figure 10:
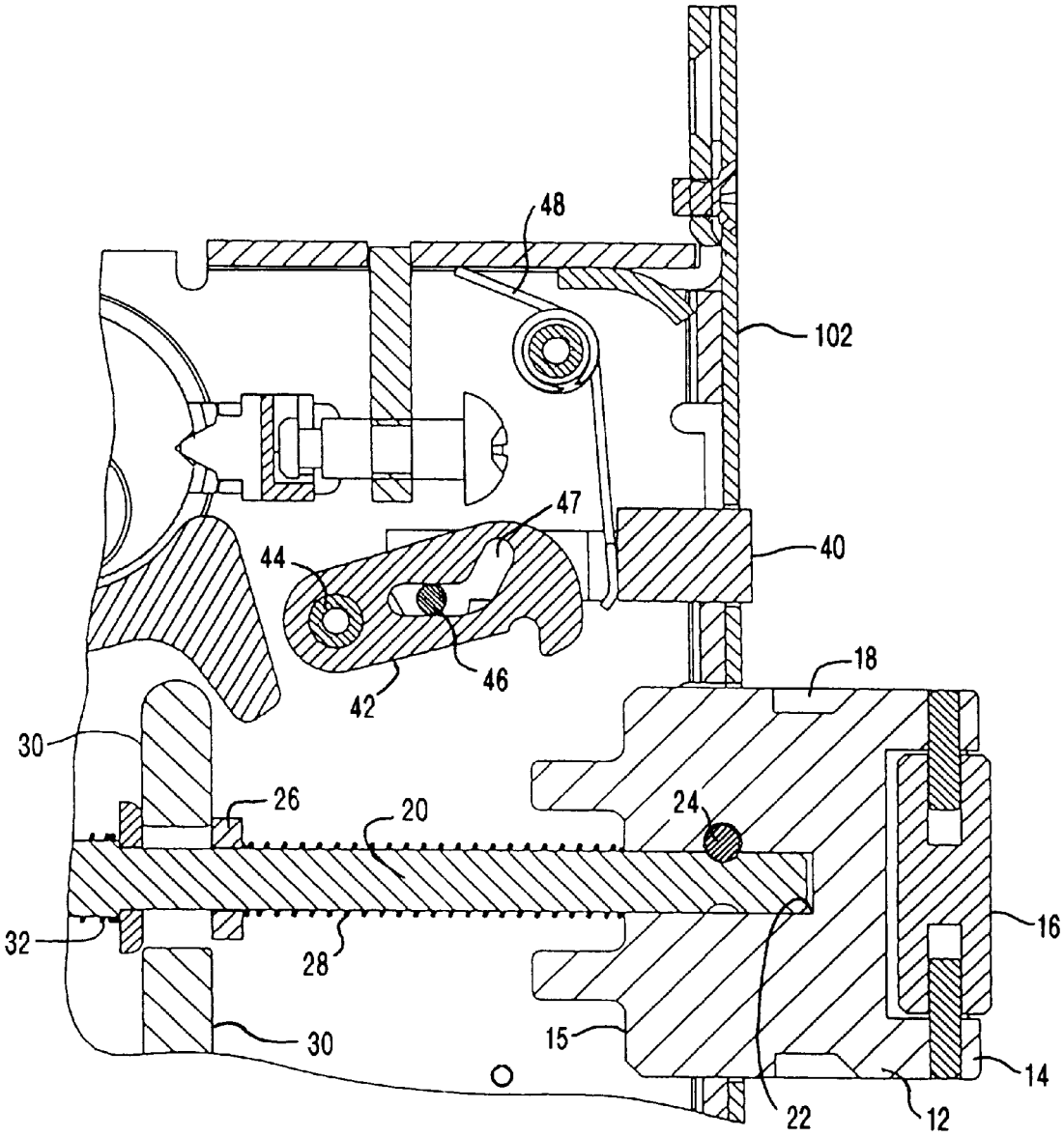
FIG. 10 is a side sectional view, partially broken away, illustrating the "closed door" configuration of the autobolt assembly components in a mortise lockset in accordance with the present invention.

The bolt 12 is preferably a generally rectangular member having a short beveled perimeter at the projected or outer end 14. The outer end 14 further includes a recessed roller 16. The bolt may be threaded to the throw rod 20 or secured by a setscrew 24 that is received in a recess of the rod. A spring 28 engages the inner end 15 of the bolt 12 and is secured at the opposing end against a stop 26. The stop 26 is fixedly mounted between a front plate, not illustrated, and the backing plate 104 of the case 100 to provide support for the slidably received throw rod 20. The spring 28 functions to bias the bolt 12 toward an extended or latched position as illustrated in FIGS. 1, 4, and 10.

Conventionally, the latch of a self-latching lockset typically has a beveled outer end. As a door closes, the beveled surface of the latch engages the strike of the door frame and is forced back into the lockset until the door reaches a position in which the latch can project into the latch opening in the strike. This has been the typical operation of a self-latching lockset and has dictated the need for a large beveled surface on the outer end of the latch.

A mortise lockset, in accordance with the present invention, achieves self-latching convenience without need for a large beveled surface on the latch or the typically short latch throw of prior art self-latching locksets. The outer end 14 of the bolt 12 has a short bevel extending less than ⅕ of the length of the projected length of the bolt.

Figure 13:
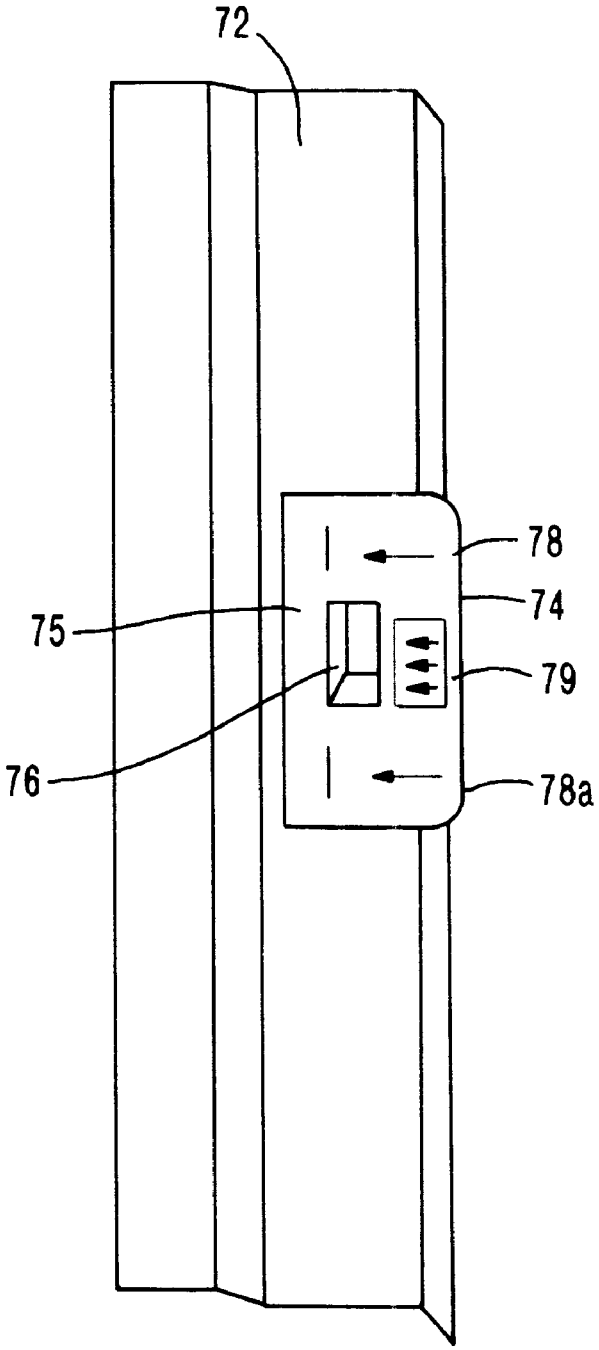
FIG. 13 is a fragmentary perspective view of a portion of a doorframe including a strike compatible with either embodiment of the mortise lockset in accordance with the present invention.

For purposes of discussing movement of the protruding parts of the autobolt lockset, and their interaction with the strike of a doorframe, reference is now made to FIG. 13. FIG. 13 illustrates a portion of a doorframe 72 including a strike 75. The strike typically incorporates an outer lip 74 that extends beyond the doorframe 72 and is curved or bent to form a camming surface which will engage protruding parts of the lockset as the door swings closed. The strike includes a latch opening 76 for receiving the latch and/or bolt.

Figure 8:
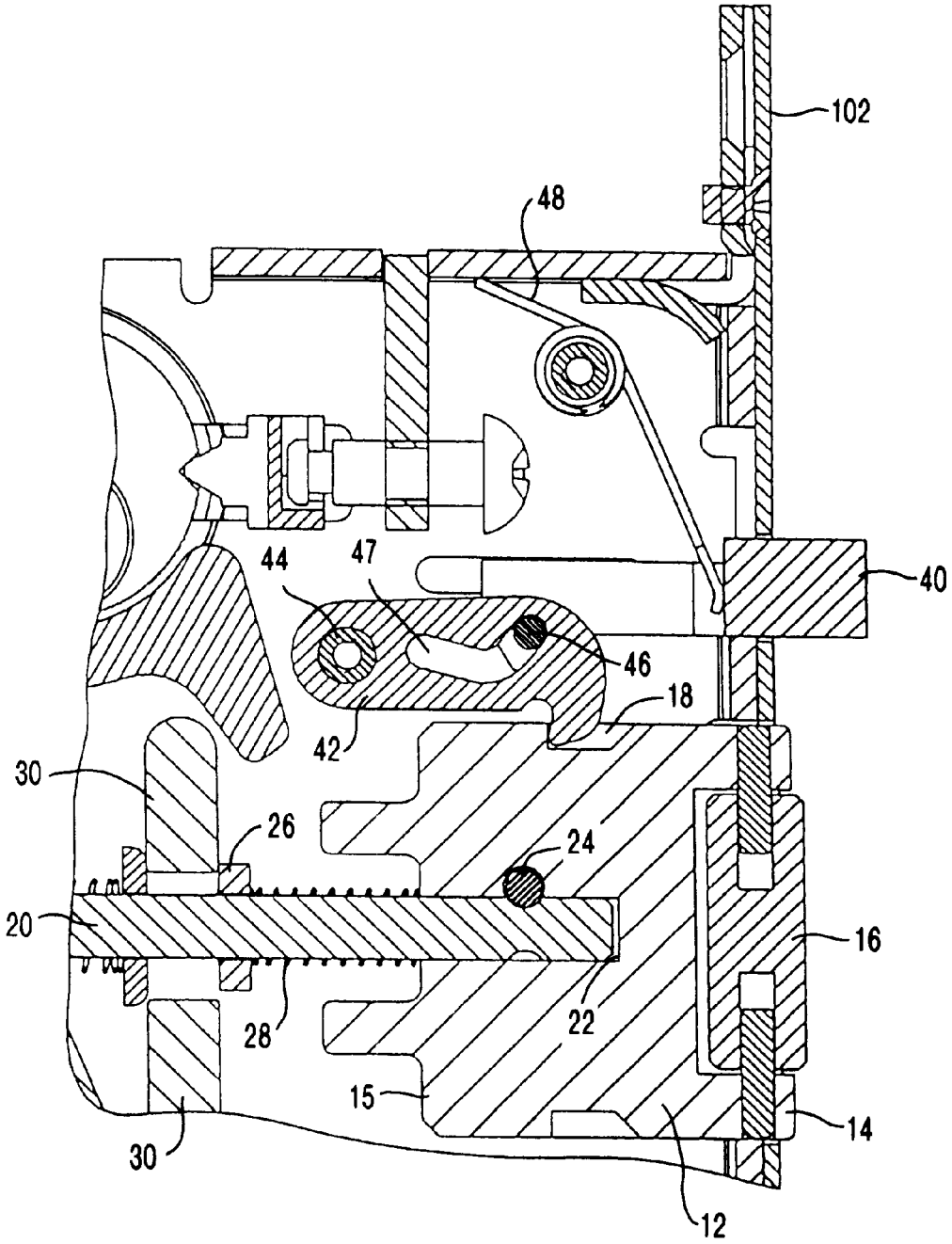
FIG. 8 is a side sectional view, partially broken away, illustrating the "open door" configuration of the autobolt assembly components in a mortise lockset in accordance with the present invention.

The function of an autobolt in accordance with the present invention is best illustrated with reference to FIGS. 8–10 in view of FIG. 13. FIG. 8 illustrates the position of the internal components of the mortise lockset 10 corresponding to a door that has been opened and is now swinging closed. The bolt is illustrated in a retracted position where only the outer tip 14 of the bolt and its recessed roller 16 project from the face plate 102. A bi-beveled auxiliary latch 40 projects from the face plate 102. The auxiliary latch pivots a hook 42 via a pin 46 that is slidably positioned in a curved slot 47 within the hook. The hook 42 is mounted to pivot on pivot point 44. The auxiliary latch 40 is biased toward an extended position by spring 48. When the door is opened, the faceplate 102 of the lockset 10 is moved away from the strike of the doorframe, allowing the auxiliary latch 40 to assume its projected position (as illustrated in FIG. 8). The pin 46 carried by the auxiliary latch 40 acts within the curved slot 47 of the hook 42 to pivot the hook into engagement with a notch 18 on the side of the bolt 12. The bolt 12 is thus held in a retracted position (see FIGS. 8 and 9) even after the latch operator is released.

Figure 9:
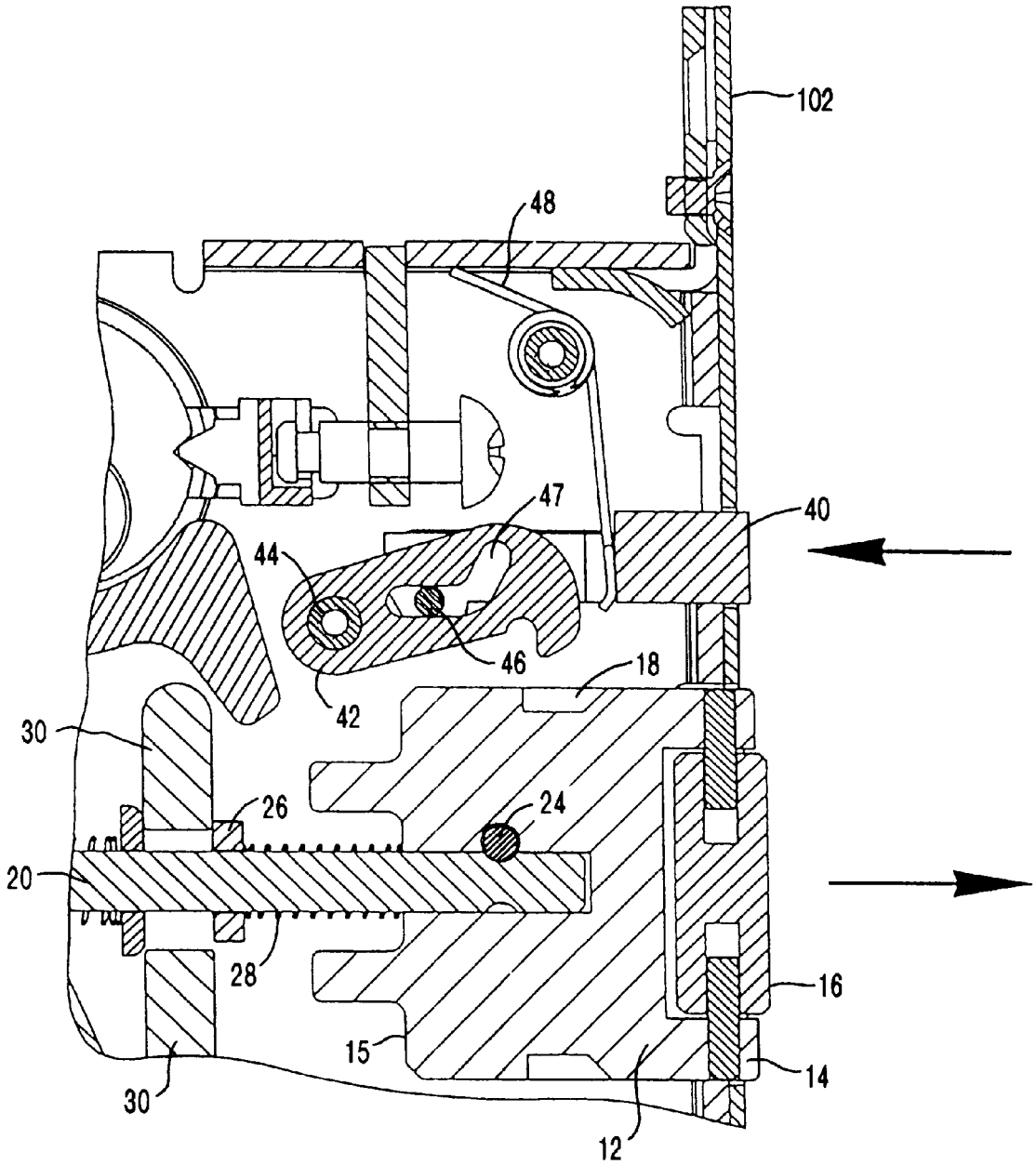
FIG. 9 is a side sectional view, partially broken away, illustrating the "closing door" configuration of the autobolt assembly components in a mortise lockset in accordance with the present invention.

With reference now to FIGS. 9 and 13, a closing door brings the latch edge of the door, including the face plate 102 of the lockset and its protruding parts (the auxiliary latch 40 and the outer end 14 of the bolt 12), into an 20 opposing parallel relationship with the door frame 72 and the strike 75. The bi-beveled tip of the auxiliary latch 40 encounters the strike 75 at location 78. The curved outer lip 74 of the strike 75 interacts with the beveled surface of the auxiliary strike 40 to urge the auxiliary bolt into a retracted position as illustrated in FIG. 9.

The recessed roller 16 in the outer end 14 of the bolt 12 also encounters the curved lip 74 of the strike 75. Engagement of the roller 16 against the strike 75 at location 79 relieves some pressure from the hooked engagement between the latch 12 and the hook 42. Inward movement of the auxiliary latch 40 causes pin 46 to move in slot 47 of the hook 42, pivoting the hook away from its engagement with the notch 18 in the bolt 12. As pictured in FIG. 9, the bolt 12 is now outwardly biased by spring 28, disengaged from the hook 42 and engaged with the strike at area 79. The slightly beveled configuration of the outer end 14 of the bolt 12 and the recessed roller 16 permit smooth sliding engagement between the lip 74 of the strike 75 and the bolt 12. The bolt rolls across the strike 75 until it is aligned with the latch opening 76 where the bolt projects into the opening, providing a latched engagement between the door and the door frame. FIG. 10 illustrates the positions of the auxiliary latch 40, hook 42 and bolt 12 in a closed and latched door.

It should be noted that the shape and extended projection of the bolt 12 are very similar to those of a deadbolt. The squared shape and extended projection provide a strong connection between the door and the doorframe. The squared bolt resists tampering by not presenting a beveled surface that can be manipulated by a thin tool in the manner applied to a typical self-latching lockset.

The latch retraction and access control features of the mortise lockset 10 are best explained with reference to FIGS. 1–7. A retraction lever 30 is mechanically connected to the throw rod 20 so that pivotal movement of the retraction lever 30 in the direction of arrow A will overcome the bias of the spring 28 and retract the bolt 12. The retraction lever is pivotable by a key operable retraction cam 62 or rotational movement produced by operators (levers or knobs) located on the secured and unsecured sides of the door. The mortise lockset 10 pictured in FIGS. 1, 4, and 7 is viewed from the unsecured (outside) of the door. Operators on the secured (inside) and unsecured (outside) sides of the door are connected to an inside cam 81 and an outside cam 80 in the lockset, respectively, for providing rotational movement to the cams.

FIG. 2 illustrates a cross-sectional view through the backing plate 104, the inside cam 81, the pivot end of the retraction lever 30, the outside cam 80 and the front plate 106. FIG. 2 also presents a cross-sectional view of the components of the selective mechanical coupling between the outside cam 80 and the retraction lever 30. A z-shaped locking piece 82 is movably connected to the retraction lever by an engagement pin 83. The locking piece 82 is captured between a convex head 84 of the engagement pin 83 and surfaces of the inside cam 81 and outside cam 80. The engagement pin 84 is slidably captured in a guide 83 in the retraction lever 30. This arrangement permits the locking piece 82 to move along an axis generally orthogonal to the axis of rotation shared by the inside cam 81, outside cam 80, and retraction lever 30.

The inside cam 81 and the outside cam 80 are mirror images of each other. Each cam 80, 81 is provided with a face 110 for engagement with the locking piece 82 and a lobe 112. The coupling arrangement is configured so that the locking piece 82 is continually engaged with a face 110 of the inside cam 81. This engagement transmits rotational force applied to the inside cam 81 to pivot retraction lever 30, retract the bolt and open the door, thus allowing free egress from the area secured by the door.

In contrast, the outside cam 80 is selectively engaged by the locking piece 82. FIG. 2 illustrates the components of the coupling in a locked position. In a locked position, the locking pin 83 and locking piece 82 are permitted to move away from the common axis of rotation shared by the inside cam 81, outside cam 80 and retraction lever 30. Such movement disengages the locking piece from the face 110 of the outside cam 80. When the mechanical coupling is in the locked position, the outside cam 80 rotates independently of the retraction lever 30. Accordingly, rotational movement applied to the outside cam 80 by an operator on the unsecured side of the door will not retract the bolt and open the door.

It should be understood that the locking piece 82 is configured so that 180° rotation of the locking piece about the engagement pin 83 reverses the secured and unsecured sides of the door. With reference to FIG. 2, a 180° rotation of the locking piece will reconfigure the clutch mechanism for continuous engagement between the locking piece 82 and the outside cam 80 while permitting selective engagement between the inside cam 81 and the locking piece 82. The inside cam is now configured to control egress while the outside cam permits unregulated entry. In this manner, the mortise lockset may be easily configured to suit the particular application.

The mechanical coupling just described is preferably electrically actuated via a motor 90 that rotates a drive shaft 96, producing linear movement in an injector 92. A pivotable injector arm 88 is engaged between the convex head 84 of the engagement pin 83 and a rounded corner 93 of the injector 92. The injector arm 88 is a passive member and is pivoted by forces exerted on it by the head 84 of the injector pin 83 and the rounded corner 93 of the injector 92. The locking piece 82 and engagement pin 83 are biased toward a locked position by spring 86. The injector 92 is coupled to the coil drive shaft 96 by a drive pin 94.

Interaction between the motor 90, coil drive shaft 96, injector 92 and drive pin 94 are best explained with reference to FIGS. 3 and 6. Drive pin 94 is carried by the injector 92 and engaged between coils of the drive shaft 96. Rotational movement of the drive shaft 96 produces lateral movement of the injector 92. Lateral movement of the injector 92 away from the mechanical coupling (FIG. 1, arrow C) permits the spring biased locking piece 82 and engagement pin 83 to pivot the injector arm 88 away from the coupling (FIG. 1, arrow B).

Figure 3:
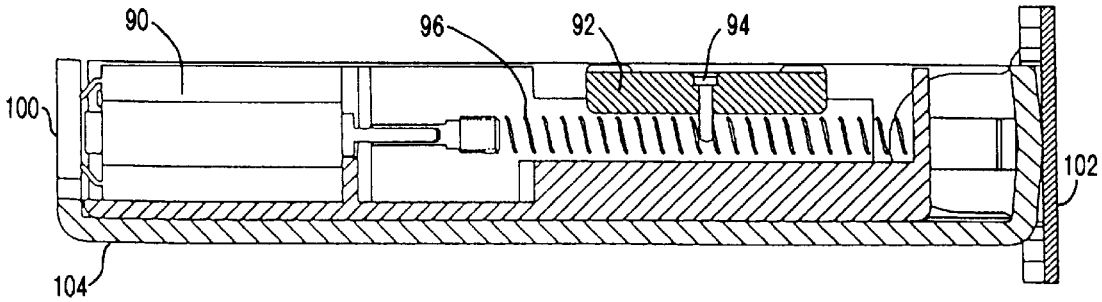
FIG. 3 is a partial sectional view of the mortise lockset of FIG. 1, taken along line 3—3 thereof.

FIGS. 1–3 illustrate the relative positions of the coupling and coupling drive components in the mortise lockset 10 corresponding to a locked condition. When locked, injector 92 and injector arm 88 are positioned to permit the locking piece 82 and engagement pin 83 to move away from the axis of the coupling to a position where the locking piece 82 is no longer engaged with the outside cam 80 (see FIG. 2)

Figure 6:
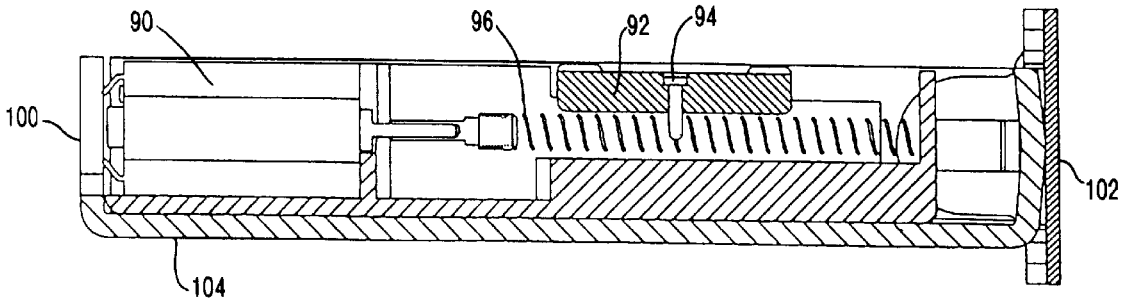
FIG. 6 is a partial sectional view of the mortise lockset of FIG. 4, taken along line 6—6 thereof.
Figure 7:
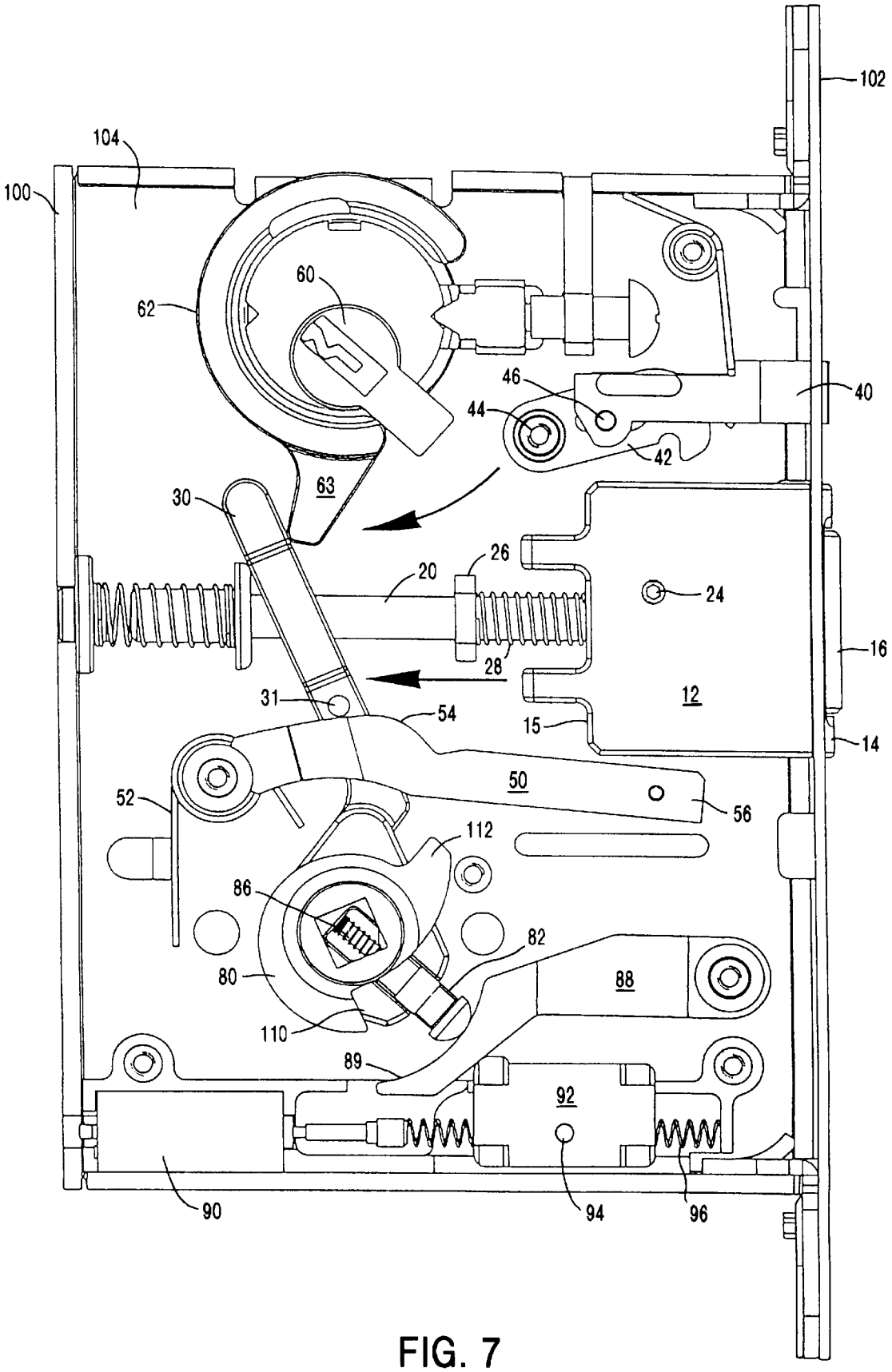
FIG. 7 is a side view illustrating the key actuation configuration of the internal components of a mortise lockset in accordance with the present invention.

FIGS. 4–6 illustrate the relative positions of the coupling and coupling drive components in the mortise lockset 10 corresponding to an unlocked condition. To achieve an unlocked condition, the motor 90 rotates drive shaft 96 so that drive pin 94 is drawn toward the coupling (FIG. 4, arrow D). Movement of the drive pin 94 and associated injector 92 cause the rounded corner 93 of the injector to engage the ramp 87 on the injector arm 88, pivoting the injector arm toward the coupling (FIG. 4, arrow E). Pivoting of the injector arm 88 overcomes the spring bias on the locking piece 82 and engagement pin 83, moving the locking piece into engagement with the outside cam 80 (see FIG. 5). When spring 86 is compressed, the locking piece is moved into engagement with both the inside and outside cams 81, 80.

When the locking piece is so engaged, rotational movement applied to an operator on the unsecured side of the door is transmitted by the outside cam 80 to the retraction lever 30 via the locking piece 82 and engagement pin 83. A downward force on a lever operator on the outside of the door will pivot retraction lever 30 away from the face plate 102 of the mortise lockset 10 acting on the throw rod 20 to retract the bolt 12.

The injector arm 88 is provided with an arcuate engagement surface 89 configured to maintain the compressed condition of spring 86 and the engaged position of the locking piece 82 throughout the pivotal movement of the retraction lever. The retraction lever is equipped with a return bias spring 32 that returns the retraction lever and associated coupling components to their pre-actuation positions as illustrated in FIG. 4.

The coil spring drive shaft 96 has the capability to store energy applied to the injector 92 by the motor 90. Under certain circumstances, the locking piece may be obstructed from achieving the unlocked position illustrated in FIG. 4. If, for example, the outside operator is held down, the outside cam is rotated counter-clockwise into a position which blocks movement of the locking piece toward the unlocked position. As a result of the blockage, energy applied by the motor 90 to move the injector 92, injector arm 88, engagement pin 83 and locking piece 82 will not result in movement of these components. However, the motor 90 will rotate the coil spring drive shaft 96 whether the injector moves or not. The drive shaft 96 is compressed beyond the drive pin 94 and stretched between the drive pin and the motor 90 by energy applied to the injector 92 by the motor. When the latch operator is released, the outside cam returns to its normal position, freeing the locking piece 82, engagement pin 83, injector arm 88 and injector 92 to achieve their unlocked positions. The energy stored in the stretched and compressed portions of the drive shaft 96 is now able to move the components to their unlocked positions.

The mortise lockset 10 incorporates a further security feature comprising a lock bar 50. The lock bar 50 is biased by spring 52 toward a lock position in which the free end 56 of the lock bar is positioned to block retraction of the projected bolt 12. The lock bar 50 is moved from the lock position by a guide pin 31 on the retraction lever 30. Pivoting the retraction lever 30 to retract the bolt 12 engages the guide pin 31 on the retraction lever with a cam surface 54 on the lock bar 50. Movement of the retraction lever 30 causes a corresponding pivot of the lock bar 50 away from its locked position. The lock bar, being internal to the mortise lockset 10, is inaccessible to a potential burglar. Effectively, the lock bar 50 may be moved from the locked position only by a corresponding movement of the retraction lever 30.

The novel configuration and features of the mortise lockset 10, including the squared bolt 12, the extended projection of the bolt, the autobolt system and lock bar 50 effectively combine the security features of a deadbolt with the convenience of a self-latching lockset.

The mortise lockset 10, in accordance with the present invention, may also be operated as a conventional keyed access control system. The mortise lockset 10 is equipped with a key cylinder 60 and a retraction cam 62. A properly cut key inserted in key cylinder 60 permits rotation of the retraction cam 62. Rotation of the retraction cam 62 brings cam lobe 63 into engagement with the end of the retraction lever 30. Movement of the retraction lever 30 induced by interaction with the retraction cam 62 is the same pivoting movement produced by the latch operators via the electromechanical coupling previously described.

It must be understood that the mortise lockset in accordance with the present invention incorporates features making it compatible with both keyed and electronic access control systems. The key cylinder 60 and retraction cam 62 may provide the primary access control or may be used as a key override feature. Incorporating electrically actuated access control features into a mortise lockset that is also equipped for key operation simplifies installation of an access control system by permitting key access control until a suitable electronic system may be installed. Further, the separately installed clutch mechanisms known in the prior art are no longer needed.

The electric power necessary to operate the motor 90 may be provided by a battery pack (not illustrated) or from a power supply. A battery powered mortise lockset may also be remotely actuated by radio, infra red or some similar signal. The signals necessary to actuate the motor 90 may also be transmitted by conductors (not illustrated) positioned within the door. While these arrangements are not illustrated, it is well known in the art to provide remote actuation of electrically operable assemblies. Any human operated or automated access control system may be used to actuate the clutch mechanism.

Figure 11:
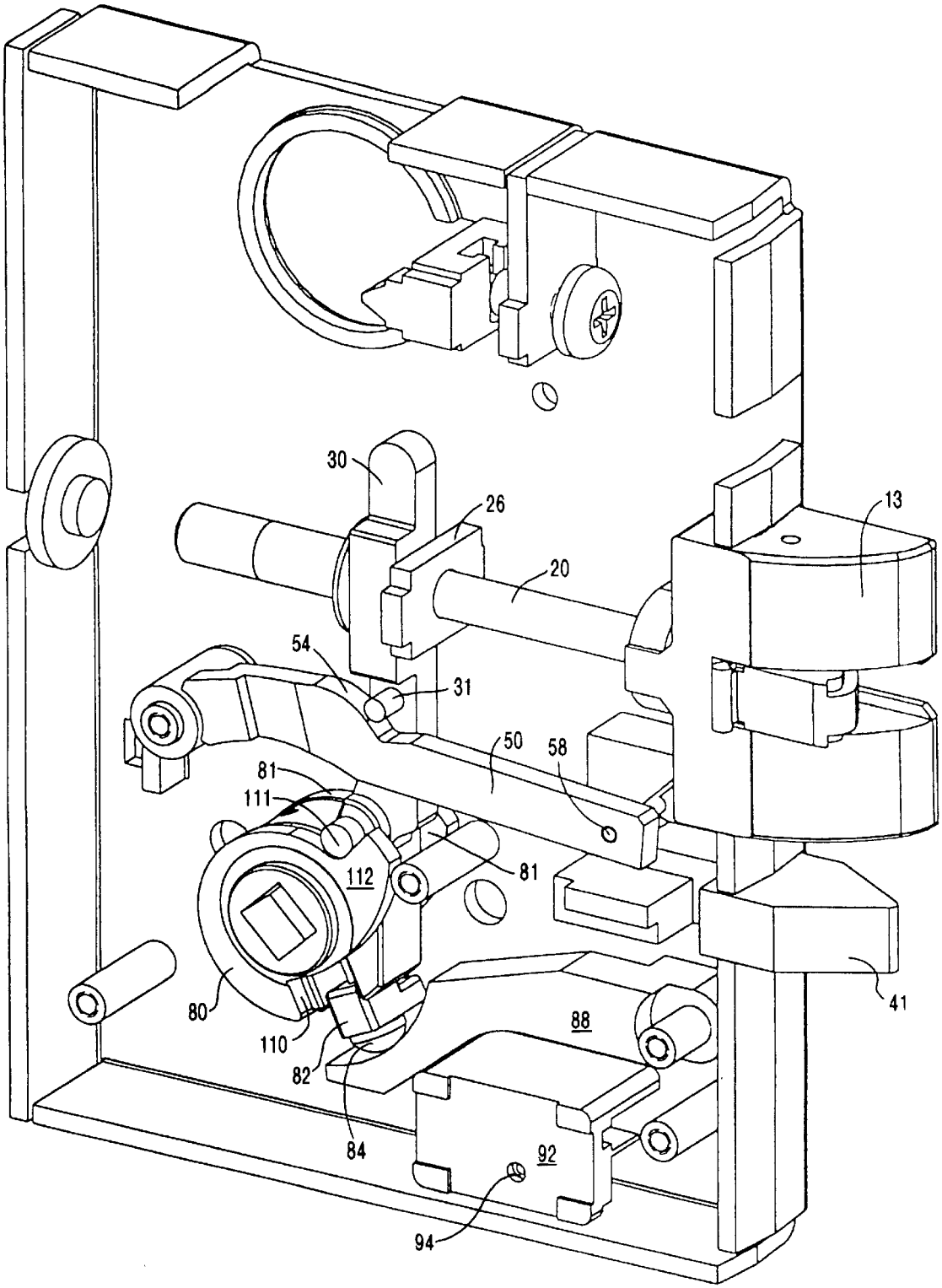
FIG. 11 is a side perspective view of an alternative embodiment of a mortise lockset in accordance with the present invention.

It should also be understood that the key and electrically actuated access control features of the mortise lockset 10 illustrated in FIGS. 1–10 are fully compatible with any form of mortise lockset, including an alternative embodiment 10*a* illustrated in FIGS. 11 and 1 2. FIG. 11 is a perspective view of an alternative embodiment 10*a* of a mortise lockset incorporating the electrically actuated internal clutch, key access control capability and lock bar features in accordance with the present invention. The alternative embodiment 10*a* also incorporates a more conventional self-latching configuration. A latch 13 with a large angled arcuate surface is spring biased toward an extended, latched position (spring not shown). The latch 13 is positioned to engage the strike of a doorframe. The force of the closing door moves the latch 13 into a retracted position until the latch is aligned with a latch opening in the strike. Once aligned with the strike opening, the latch 13 projects to a latched position. Because the latch operator on the unsecured side of the door is selectively engaged with the retraction lever 30, the latched door is automatically locked.

The alternative embodiment 10*a* is equipped with a modified form of the lock bar security feature. The free end 56 of the lock bar 50 is coupled to an alternative auxiliary bolt 41 by a pin 58. The lock bar is biased toward a lock position in which the lock bar blocks retraction of the latch 13. The lock bar 50 must be moved from the lock position to permit the door to be opened and again to permit the door to close and latch. The lock bar control surface 54 and retraction lever mounted guide pin 31 cooperate to move the lock bar from the lock position when the door is being opened. As in the mortise lockset 10, pivoting of the retraction lever 30 moves the lock bar 50 and also retracts the latch 13.

Figure 12:
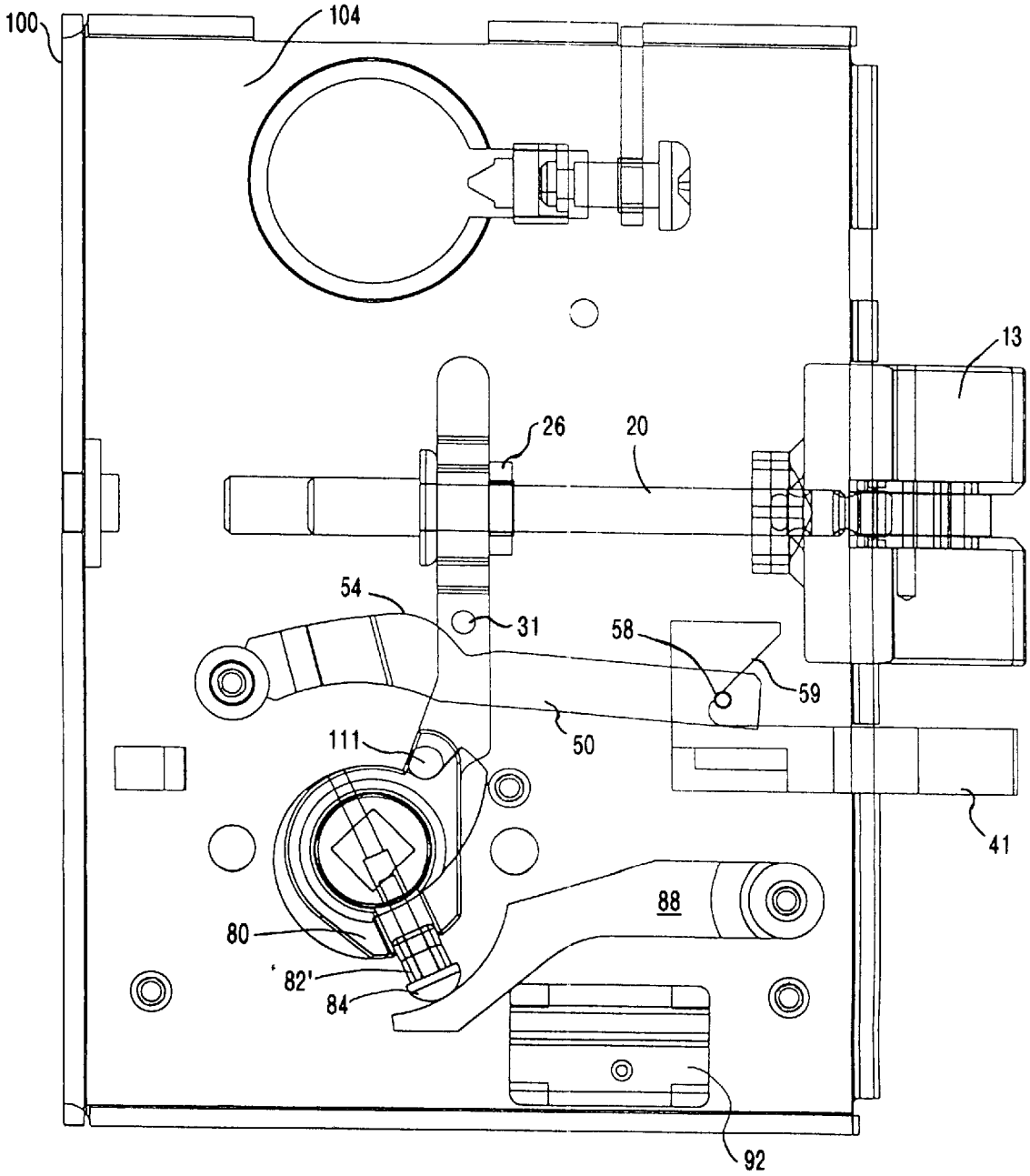
FIG. 12 is a side view of the mortise lockset with internal clutch of FIG. 11.

In the illustrated embodiment 10*a,* the lock bar 50 must be restrained from achieving a lock position so that the latch will be permitted to retract upon encountering the strike as the door closes. With reference to FIGS. 11, 12 and 13, when the door is open and the latch 13 and auxiliary latch 41 are in their projected positions a control surface 59 on the auxiliary latch 41 acts on guide pin 58 to restrain the lock bar from achieving the lock position. The closing door engages the latch 13 and bi-beveled auxiliary latch 41 against the strike 75 of the doorframe 72 at areas 79 and 78*a* respectively, urging both the latch and auxiliary latch into a retracted position. In a retracted position, the control surface 59 of the auxiliary latch 41 permits the lock bar to pivot to the lock position. Thus, the self-latching latch 13 of the alternative embodiment 10*a* incorporates tamper resistant features typical of a dead bolt.

The mortise lockset 10*a* illustrated in FIGS. 11 and 12 may be used to explain some features consistent with the present invention not found in the mortise lockset 10 of FIGS. 1–10. For example, the mortise lockset 10*a* of FIGS. 11 and 12 is illustrated from the secured or inside of the door. From this side, the cam facing the viewer is the inside cam 80. The inside cam 80 is continuously coupled to the retraction lever 30 by the engagement of cam lobe 112 with a projection 111 from the retraction lever 30. Rotational motion applied to the inside cam 80 is directly transmitted to pivot the retraction lever 30 which moves the lock bar from the locked position and retracts the latch 13. In the mortise lockset 10, a Z-shaped locking piece is positioned to engage the inside cam 81 continuously and selectively engage the outside cam 80.

In contrast, the mortise lockset 10*a* provides the projection 111 to continuously engage the inside cam 81. The locking piece 82' is L-shaped, a protruding part of the L selectively engageable with the outside cam 81. FIGS. 11 and 12 illustrate the coupling components of the mortise lockset 10*a* in a locked condition. The injector 92, injector arm 88, engagement pin 83, and locking piece 82' are positioned so that the extension of the locking piece is not engaged with the outside cam 81. When the coupling components are so positioned the operator and outside cam 81 are in a free wheel state relative to the retraction lever 30 and rotational motion applied to the operator on the unsecured side of the door will not unlock the door.

In all other respects, the mortise lockset 10*a* functions in the same manner as the mortise lockset 10. It should be noted that the mortise lockset 10*a* incorporates the same key actuation and electrically actuated coupling as described in the mortise lockset 10. It should also be noted that the mortise lockset 10*a* incorporates the lock bar feature, adding security to the convenience of a self-latching lockset.

While preferred embodiments of the foregoing invention have been set forth for purposes of illustration, the foregoing description should not be deemed a limitation of the invention herein. Accordingly, various modifications, adaptations, and alternatives may occur to one skilled in the art without departing from the spirit and scope of the invention.

What is claimed is:

1. A lockset for mounting in a mortise of a door having a secured side and an unsecured side, said lockset comprising:

a lock case;

a latch movably mounted relative to said case and having a retracted position and a projected position, said latch being biased toward the projected position;

latch retraction means for moving said latch from said projected position to said retracted position, said retraction means comprising a lever pivotable about a first axis;

first coupling means for translating rotational motion applied at a secured side of a door to operate said retraction means;

second coupling means for selectively translating rotational motion applied at an unsecured side of the door to operate said retraction means;

clutch means for selectively engaging said second coupling means and said retraction means, said clutch means comprising:

engagement means carried by said retraction means in fixed rotational relationship therewith for selectively engaging said second coupling means, said engagement means biased toward a non-engaged position;

injector means for urging said engagement means into engagement with said second coupling means; and drive means for driving said injector means between a first position in which said injector means allows said engagement means to remain in said non-engaged position and a second position in which said injector means urges said engagement means into engagement with said second coupling means, wherein said latch, latch retraction means, first and second coupling means and clutch means are contained within said lock case and engagement of said engagement means with said second coupling means permits rotational motion applied at said unsecured side of said door to operate said retraction means.

2. The lockset of claim 1, said lockset further comprising:

cam means for acting on said latch retraction means, said cam means rotatable in response to a key means, wherein rotation of said cam means moves said latch from said projected position to said retracted position.

3. The lockset of claim 1, wherein said latch comprises an outer end and an inner end, said lockset further comprising:

lock bar means for preventing retraction of said latch, said lock bar means movable between a lock position in which said lock bar means obstructingly engages the inner end of said latch thereby preventing retraction of said latch and an unlock position in which said lock bar means does not prevent retraction of said latch.

4. The lockset of claim 3, wherein said lock bar means is interactive with said latch retraction means so that retraction of said latch by said latch retraction means also moves said lock bar means from said lock position to said unlock position.

5. The lockset of claim 4, said lockset further comprising:

auxiliary latch means for restraining said lock bar means, said auxiliary latch means movable between a first position in which said auxiliary latch means projects from said lock case and restrains said lock bar means in said unlock position and a retracted position in which said auxiliary latch permits said lock bar means to achieve said lock position.

6. The lockset of claim 1, wherein said latch means includes an inner end and an outer end, said outer end including at least one roller means mounted within a recess in said outer end for rotation therein.

7. The lockset of claim 1, said lockset comprising:

auxiliary latch means for restraining said latch, said auxiliary latch means including an auxiliary latch mounted within said lock case and movable between a projected position where said auxiliary latch projects from said lock case and a retracted position where said auxiliary latch does not project from said lock case, and hook means for engaging said latch, wherein engagement of said hook means with said latch restrains said latch in said retracted position and said auxiliary latch is interactive with said hook means whereby movement of said auxiliary latch from said projected position to said retracted position moves said hook means out of engagement with said latch, thereby permitting said latch to achieve said projected position.

8. The lockset of claim 1, wherein said drive means comprises:

an electric motor having a rotating shaft; and a coil drive shaft connected to said rotating shaft and engaged with said injector means so that rotation of said drive shaft in a first direction urges said injector means from said first position to said second position and rotation of said drive shaft in a second direction urges said injector from said second position to said first position.

9. The lockset of claim 8, wherein said drive shaft comprises a spring, and should said injector means be temporarily immovable during rotation of said drive shaft, said spring stores energy which is applied to move said injector means.

10. A lockset comprising:

a lock case;

a latch movably mounted to said case, said latch having a projected position and a retracted position, said latch being biased toward the projected position;

a latch retraction lever pivotable about a first axis from a first position to a second position, said lever being engaged with said latch such that movement of said lever from said first position to said second position causes a corresponding movement of said latch from said projected position to said retracted position;

a first coupler rotatable about said first axis, said first coupler engaged with said lever such that rotation of said coupler causes a corresponding movement of said lever from said first position to said second position;

a second coupler rotatable about said first axis;

an engagement pin guide carried by said lever in fixed rotational relationship therewith;

an engagement pin supported by said guide for rotation therewith about said first axis, said pin movable in a direction generally orthogonal to said first axis between an engaged position in which said pin rotationally couples said second coupler to said lever and a non-engaged position in which said coupler and said lever move independently, said pin being biased toward the non-engaged position;

an injector arm pivotably movable about a second axis, said arm including a surface engagable with said pin, said arm movable between a locked position in which said surface permits said pin to remain in said non-engaged position and an unlocked position in which said surface urges said pin into said engaged position;

an injector retained in said case and engageable with said arm, said injector movable between an inject position in which said injector urges said arm to said unlocked position and a non-inject position which permits said arm to remain in the non-inject position; and a drive assembly comprising a drive motor and a drive shaft rotatably driven by said motor and engageable with said injector such that rotation of said shaft in a first direction urges said injector from said non-inject position to said inject position and rotation of said shaft in a second direction urges said block from said inject position to said non-inject position, wherein said motor is remotely activatable and actuation of said motor causes rotation of said shaft in said first direction which urges said block to said inject position to urge said arm to said unlocked position, urging said pin into said engaged position which couples said lever to said second coupler, allowing rotation of said second coupler to move said lever to said second position to thereby move said latch to the retracted position.

11. The lockset of claim 10, wherein said retraction lever comprises an opposed free end opposite said first axis, said lockset further comprising:

a key cylinder mounted to said lock case, said key cylinder rotatable in response to a key;

a retraction cam secured to said key cylinder for rotation therewith, said retraction cam including a lobe positioned to engage the free end of said retraction lever, wherein rotation of said key cylinder and retraction cam pivots said retraction lever from said first position to said second position.

12. The lockset of claim 10, wherein said latch comprises an outer end and an inner end, said lockset further comprising:

a lock bar biased toward a lock position and pivotable between said lock position in which said lock bar obstructingly engages the inner end of said latch thereby preventing retraction of said latch and an unlock position in which said lock bar does not obstructingly engage the inner end of said latch and said latch may be retracted.

13. The lockset of claim 12, wherein said lock bar includes a cam surface and said retraction lever includes a guide pin, said guide pin slidably engaged with said cam surface and pivoting of said retraction lever from said first position to said second position pivots said lock bar from said lock position to said unlock position.

14. The lockset of claim 13, wherein said lock bar includes a pin adjacent said free end and said lockset comprises an auxiliary latch movable between a projected position and a retracted position, said auxiliary latch biased toward said projected position and including a guide surface slidably engaged with said pin, said guide surface configured to restrain said lock bar from achieving said lock position when said auxiliary latch is in said projected position and to permit said lock bar to achieve said lock position when said auxiliary latch is in said retracted position.

15. The lockset of claim 10, wherein said latch comprises a generally rectangular member having an inner end and an outer end, said outer end including at least one recessed roller rotatably mounted in said outer end.

16. The lockset of claim 10, wherein said latch has a projected length extending from said lock case to said outer end and said outer end includes a beveled perimeter, said bevel extending from said outer end toward said lock case no more than one fifth of the projected length of said latch.

17. The lockset of claim 10, said lockset comprising:

an auxiliary latch slidably mounted within said lock case and movable between a projected position where said auxiliary latch projects from said lock case and a retracted position where said auxiliary latch does not project from said lock case, said auxiliary latch biased toward said projected position; and a hook pivotably mounted within said lock case and engaged with said auxiliary latch so that retraction of said latch pivots said hook from a first position in which said hook engages a notch in said latch, thereby restraining said latch in said retracted position to a second position in which said hook releases said latch thereby permitting said latch to extend to said projected position.

* * * * *